US006189420B1

(12) United States Patent
Shiao

(10) Patent No.: US 6,189,420 B1
(45) Date of Patent: Feb. 20, 2001

(54) SCREWDRIVER HANDLE WITH AN INCLINATION POSITIONING UNIT

(76) Inventor: Hsuan-Sen Shiao, No. 15-1, Lane 369, Min-Chuan Rd., Taichung City (TW)

( * ) Notice: Under 35 U.S.C. 154(b), the term of this patent shall be extended for 0 days.

(21) Appl. No.: 09/516,851

(22) Filed: Mar. 2, 2000

(51) Int. Cl.[7] ..... B25B 13/46

(52) U.S. Cl. ..... 81/60; 81/177.8; 81/489; 403/96; 403/84

(58) Field of Search ..... 81/60, 177.8, 177.9, 81/177.7, 489; 403/327, 326, 325, 321, 84, 103, 119

(56) References Cited

U.S. PATENT DOCUMENTS 579,277 * 3/1897 Lord et al. ..... 81/177.8
621,869 * 3/1899 Stynsberg ..... 81/177.8
1,256,565 * 2/1918 Inghram ..... 15/146
1,649,951 * 11/1927 English ..... 403/96
4,611,514 * 9/1986 Hyde ..... 81/60
5,056,952 * 10/1991 Gringer ..... 403/96
5,122,063 * 6/1992 Cooper ..... 439/13
5,207,755 * 5/1993 Ampian ..... 15/230.11
5,287,869 * 2/1994 Wu ..... 135/25.1
5,347,883 * 9/1994 Thony ..... 74/551.3
5,353,892 * 10/1994 Lu ..... 182/163
5,515,754 * 5/1996 Elkins ..... 81/177.9
5,620,272 * 4/1997 Sheng ..... 403/96
5,624,199 * 4/1997 Cheng ..... 403/100
5,661,942 * 9/1997 Palmer ..... 52/653.2
5,694,818 * 12/1997 Nickipuck ..... 81/60
5,737,982 * 4/1998 Lin ..... 81/58.3
5,927,162 * 7/1999 Huang ..... 81/177.8
6,053,076 * 4/2000 Barnes ..... 81/60

* cited by examiner

*Primary Examiner*—James G. Smith
*Assistant Examiner*—Hadi Shakeri
(74) *Attorney, Agent, or Firm*—Renner, Otto, Boisselle & Sklar, LLP

(57) ABSTRACT

A screwdriver-type tool includes a handle having first and second handle parts connected pivotally to each other. An inclination positioning unit is provided such that the first and second handle parts are rotatable between an alignment position, where the first and second handle parts are aligned with each other, and an inclined position, where the first and second handle parts form an obtuse angle therebetween.

4 Claims, 8 Drawing Sheets

SCREWDRIVER HANDLE WITH AN INCLINATION POSITIONING UNIT

BACKGROUND OF THE INVENTION

1. Field of the Invention

The present invention relates to a screwdriver, more particularly to a handle for a screwdriver-type tool which includes two handle parts that are interconnected pivotally.

2. Description of the Related Art

FIG. 1 illustrates a conventional screwdriver according to U.S. Pat. No. 5,069,091, and which includes a first handle part 4 fixedly connected to a shank (shown in perforated lines) at one end thereof and pivotally connected to a second handle part 5 at the other end thereof. The second handle part 5 is rotatable relative to the first handle part 4 between an alignment position, where the first and second handle parts 4,5 are aligned with each other, and an inclined position, where the first and second handle parts 4,5 form an obtuse angle therebetween in order to permit application of a torque on the second handle part 5 for driving the shank.

The drawbacks of the aforementioned conventional screwdriver are as follows:

It is noted that during use of the conventional screwdriver, the inclined position of the second handle part 5 is still variable, because no locking device is applied between the first and second handle parts 4,5 in order to immobilize the same. Furthermore, the thumb (B) or fingers of the operator may be pinched and injured due to position variation of the second handle part 5 with respect to the first handle part 4.

Referring to FIGS. 2 and 3, another conventional screwdriver according to U.S. Pat. No. 4,825,734 is shown to include a handle having first and second handle parts 1,2 and a pivot 3 which extends through the first and second handle parts 1,2 for pivotal connection therebetween. The first and second handle parts 1,2 are pivotable between an alignment position, where the first and second handle parts 1,2 are aligned with each other, and an inclined position, where the first and second handle parts 1,2 form an obtuse angle therebetween for application of a torque on the second handle part 2 so as to drive the shank 101. A spring-biased positioning element 104 is provided for retaining the first and second handle parts 1,2 at the alignment position. However, the spring-biased positioning element 104 is unable to immobolize the first and second handle parts 1,2 at the inclined position. As a result, pinching of the user's fingers is still possible.

SUMMARY OF THE INVENTION

Therefore, the object of this invention is to provide a screwdriver handle with an inclination positioning unit so as to eliminate the drawbacks that generally result from the use of the conventional screwdriver with a two-piece handle.

Accordingly, a handle for a screwdriver-type tool of the present invention includes an elongated first handle part and an elongated second handle part. The first handle part has an integral wall with a positioning hole unit that is formed therethrough. The second handle part is connected pivotally to an end of the first handle part at an end thereof and is rotatable between an alignment position, where the first and second handle parts are aligned with each other, and a first inclined position, where the first and second handle parts form an obtuse angle therebetween. The second handle part has a first spring-biased positioning element and a second spring-biased positioning element, which are retained thereon. When the second handle part is at the alignment position, the first spring-biased positioning element extends through the positioning hole unit in the first handle part for locking the second handle part at the alignment position. In this situation, the outer end of the first spring-biased positioning element can be pushed inwardly to disengage the first spring-biased positioning element from the positioning hole unit in the first handle part so as to unlock the first and second handle parts from each other, thereby permitting rotation of the second handle part to the first inclined position. When the second handle part is at the first inclined position, the second spring-biased positioning element extends through the positioning hole unit in the first handle part for locking the second handle part at the first inclined position. In this situation, the outer end of the second spring-biased positioning element can be pushed inwardly to disengage the second spring-biased positioning element from the positioning hole unit in the first handle part so as to unlock the first and second handle parts from each other, thereby permitting rotation of the second handle part to the alignment position.

BRIEF DESCRIPTION OF THE DRAWINGS

Other features and advantages of this invention will become more apparent in the following detailed description of a preferred embodiment of this invention, with reference to the accompanying drawings, in which.

DETAILED DESCRIPTION OF THE PREFERRED EMBODIMENT

Figure 1:
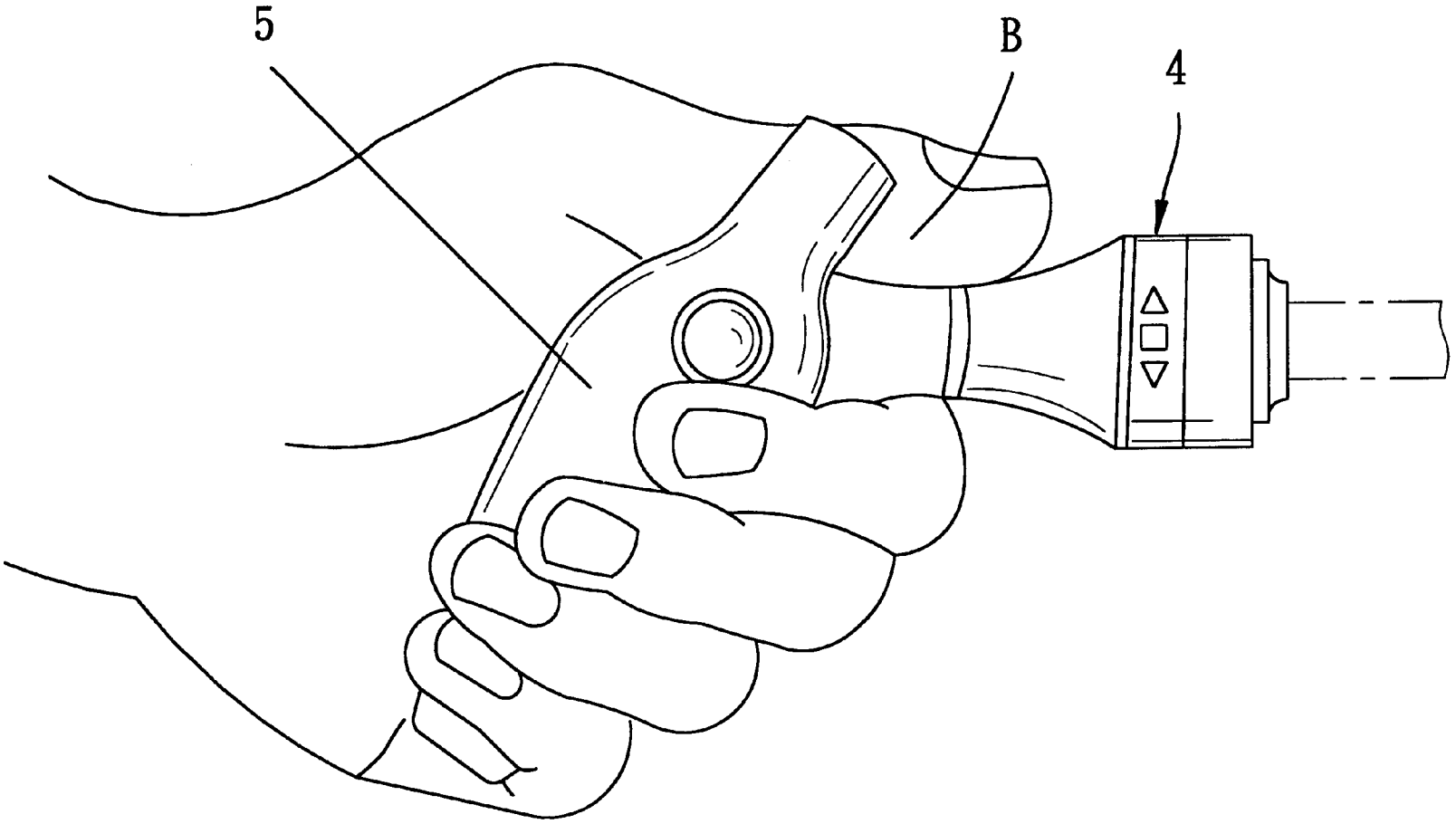
FIG. 1 PRIOR ART
FIG. 1 illustrates a conventional screwdriver according U.S. Pat. No. 5,069,091 in a state of use.
Figure 2:
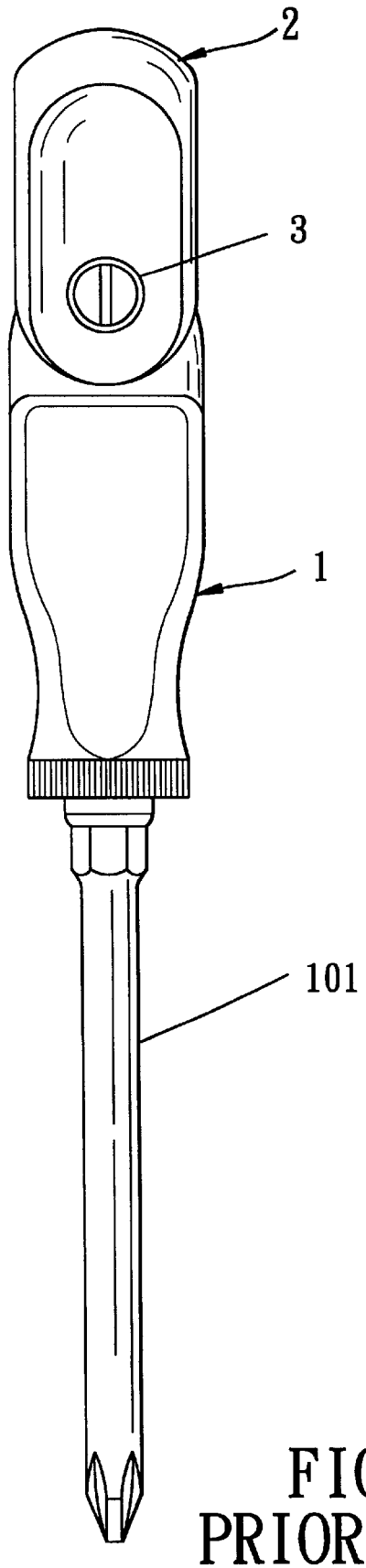
FIG. 2 PRIOR ART
FIGS. 2 and 3 respectively illustrate perspective and sectional views of a conventional screwdriver according to U.S. Pat. No. 4,825,734.
Figure 3:
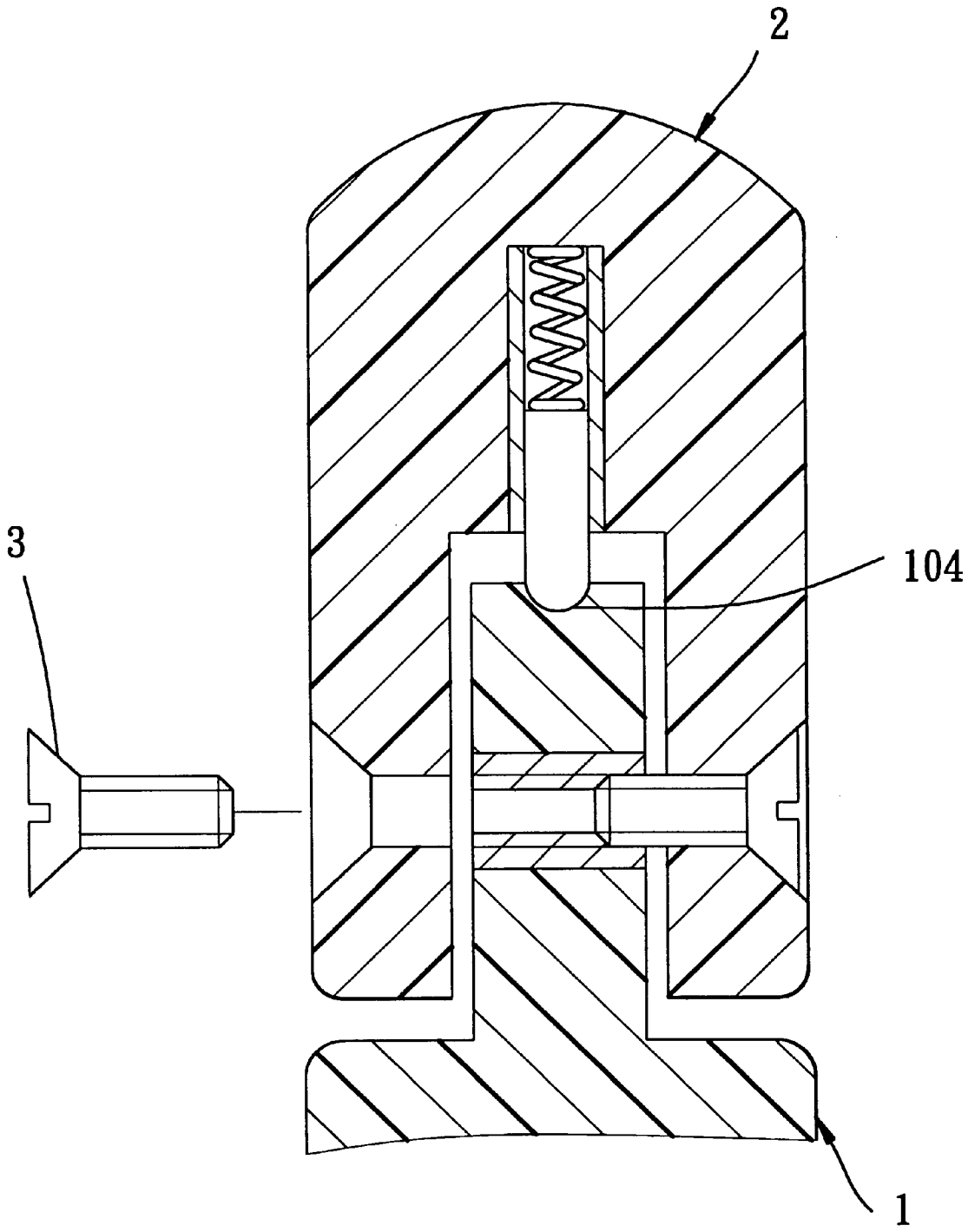
FIG. 3 PRIOR ART
Figure 4:
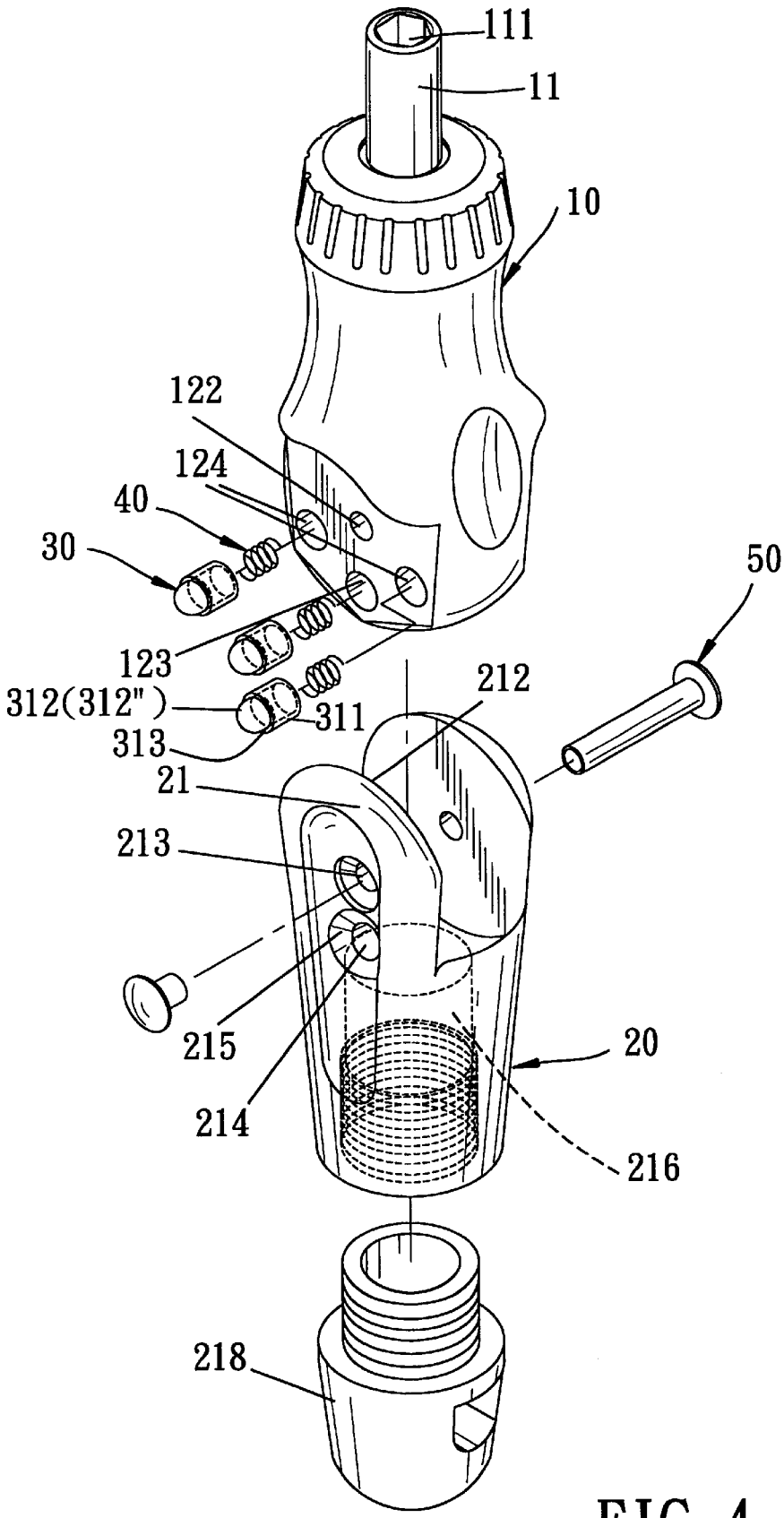
FIG. 4 is a partly exploded and perspective view of a preferred embodiment of a handle for screwdriver-type tool according to the present invention.
Figure 5:
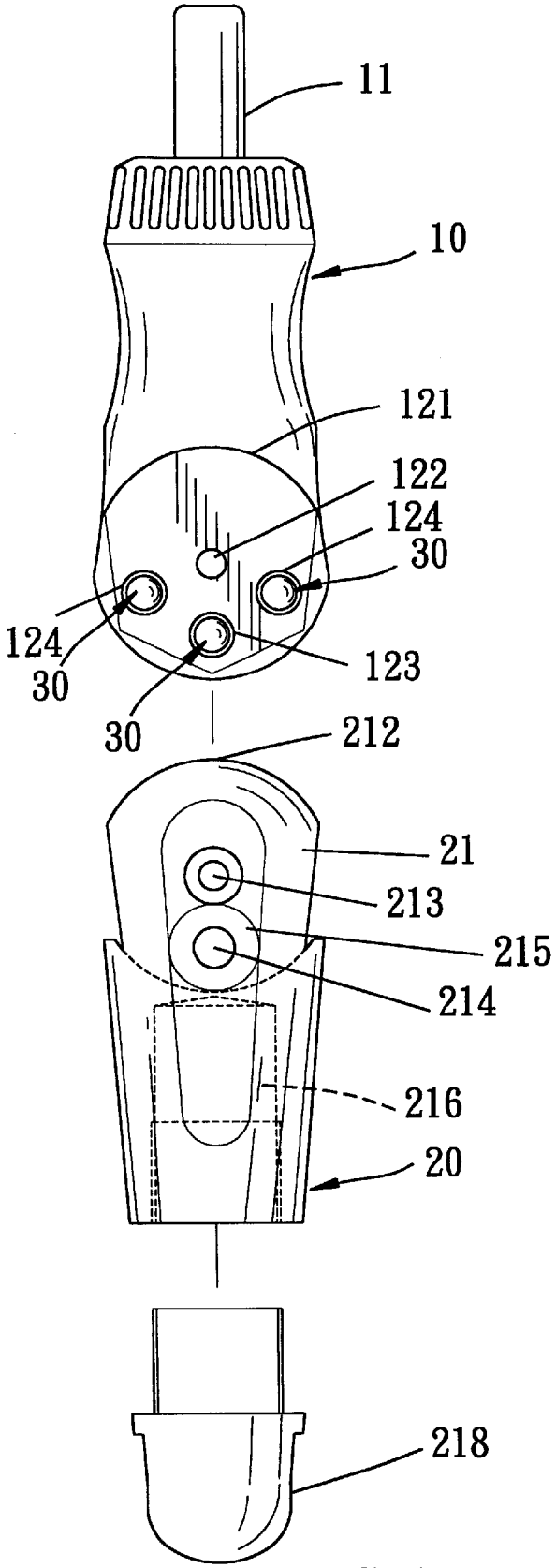
FIG. 5 is a partly exploded side view of the preferred embodiment.

Referring to FIGS. 4 and 5, the preferred embodiment of a handle for a screwdriver-type tool of the present invention is shown to include a shank 11, an elongated first handle part 20 and an elongated second handle part 10.

As illustrated, the first handle part 20 has an integral wall 21 with a positioning hole unit 214 that is formed therethrough.

Figure 6:
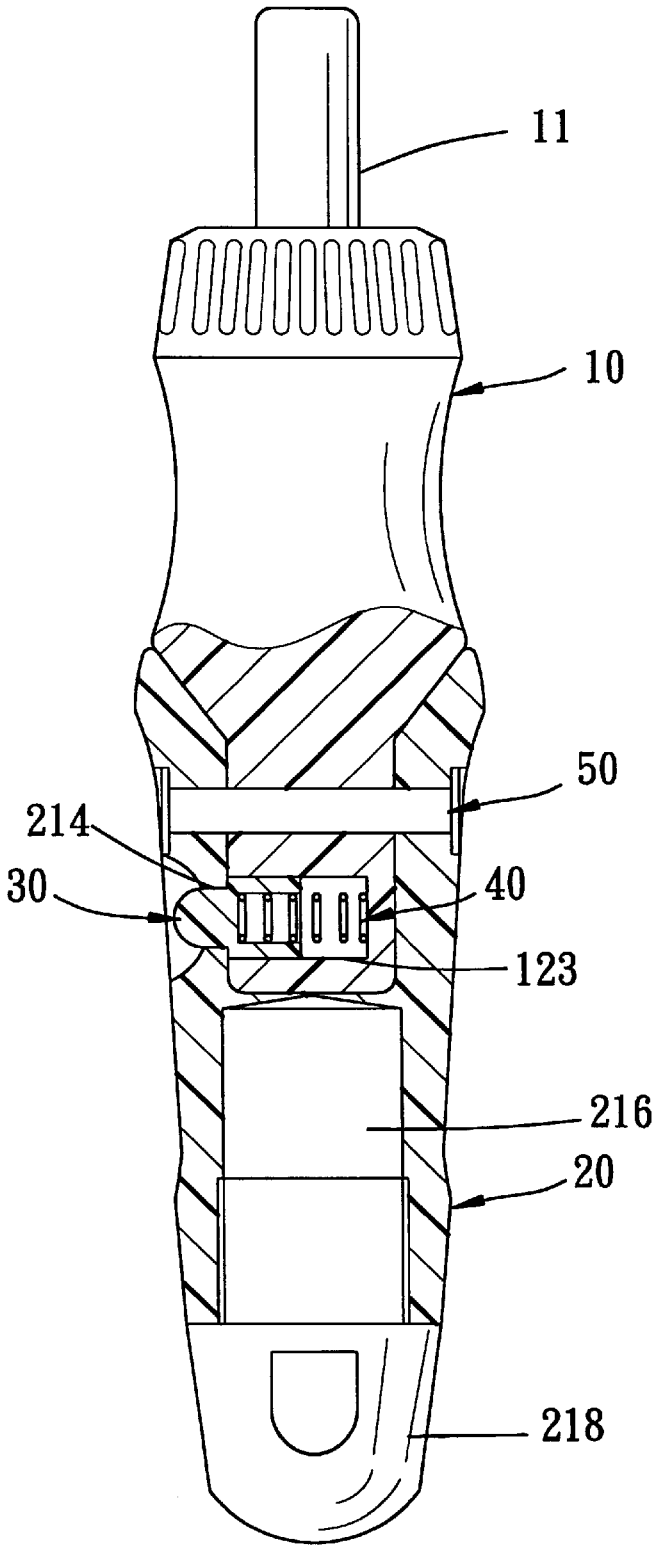
FIG. 6 is a partly sectional view of the preferred embodiment, illustrating a second handle part at an alignment position.
Figure 7:
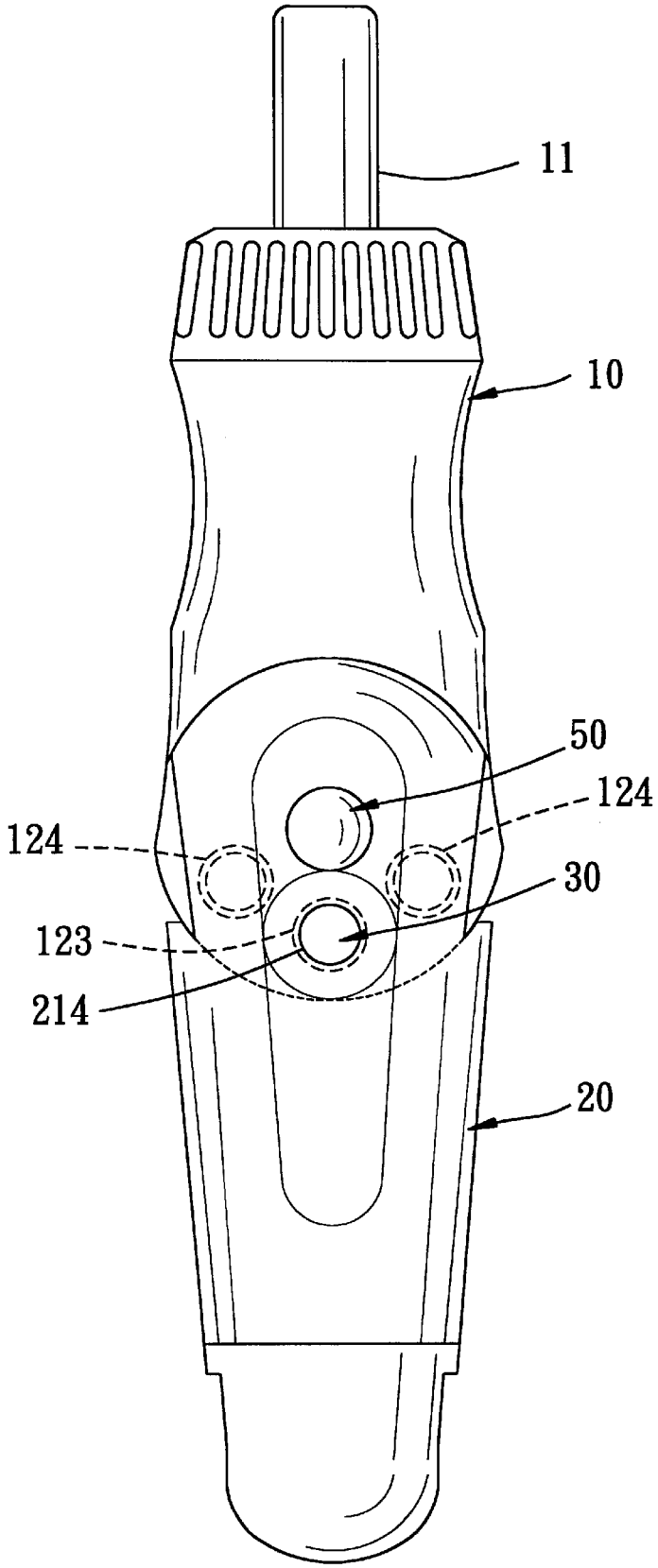
FIG. 7 is a side view of the preferred embodiment, in which the second handle part is at the alignment position.
Figure 8:
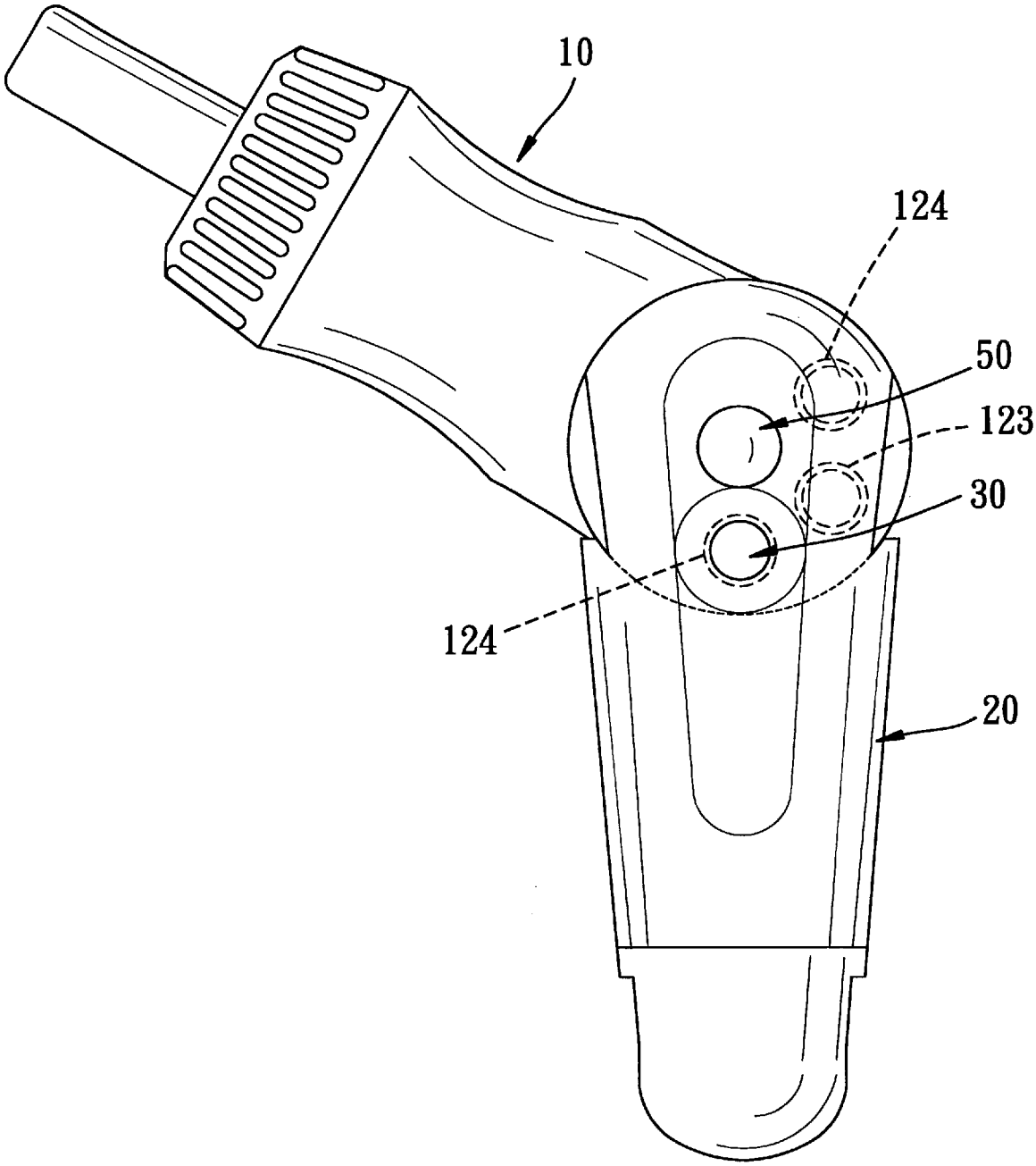
FIG. 8 is a side view of the preferred embodiment, in which the second handle part is at an inclined position.

The second handle part 10 is connected pivotally to an end of the first handle part 20 at an end thereof by means of a pivot 50, and to the shank 11 at the other end thereof. The second handle part 10 is rotatable between an alignment position as shown in FIG. 7, where the first and second handle parts 20, 10 are aligned with each other, and a first inclined position as shown in FIG. 8, where the first and second handle parts 20, 10 form an obtuse angle therebetween. The second handle part 10 has a first spring-biased positioning element 30 and a second spring-biased positioning element 30, which are retained thereon and which respectively have an outer end. When the second handle part 10 is at the alignment position as shown in FIG. 6, the first spring-biased positioning element 30 extends through the positioning hole unit 214 in the first handle part 20 in such a manner that the outer end 312 thereof projects from the positioning hole unit 214 for locking the second handle part 10 at the alignment position. In this situation, the outer end 312 of the first spring-biased positioning element 30 can be pushed inwardly to disengage the first spring-biased positioning element 30 from the positioning hole unit 214 in the first handle part 20 so as to unlock the first and second handle parts 20, 10 from each other, thereby permitting rotation of the second handle part 10 to the first inclined position with respect to the first handle part 20.

When the second handle part 10 is at the first inclined position, the second spring-biased positioning element 30 extends through the positioning hole unit 214 in the first handle part 20 for locking the second handle part 10 at the first inclined position. In this situation, the outer end 312 of the second spring-biased positioning element 30 can be pushed inwardly to disengage the second spring-biased positioning element 30 from the positioning hole unit 214 in the first handle part 20 so as to unlock the first and second handle parts 20,10 from each other, thereby permitting rotation of the second handle part 10 to the alignment position.

In the preferred embodiment, the first handle part 20 has two spaced walls 21 integrally formed therewith. The walls 21 are formed with pivot holes 213 aligned with a pivot hole 122 in the second handle part 10. The left wall 21 has a counterbore 215 which is formed therethrough and which has a uniform-diameter inner section that constitutes the positioning hole unit 214, and an enlarged outer section that has a diameter larger than that of the uniform-diameter inner section. When the second handle part 10 is at the alignment position as shown in FIG. 6, the outer end 312 of the first spring-biased positioning element 30 is located in the enlarged outer section. When the second handle part 10 is at the first inclined position as shown in FIG. 8, the outer end 312 of the second spring-biased positioning element 30 is located in the enlarged outer section for preventing undesired contact of an external article and a finger of the user with the outer end 312 of each of the first and second spring-biased positioning elements 30.

The second handle part 10 further includes a third spring-biased positioning element 30 retained therein. When the second handle part 10 is at a second inclined position, the third spring-biased positioning element 30 extends through the positioning hole unit 214 in the first handle part 20 for locking the second handle part 10 at the second inclined position. Preferably, the second handle part 10 is formed with three element retention bores 123, 124 which are angularly spaced from the pivot hole 122 via which the pivot 50 is inserted for establishing a pivotal connection between the first and second handle parts 20,10. Under such a condition, the first and second handle parts 20,10 cooperatively form the same obtuse angle when the second handle part 10 is at the first and second inclined positions.

Furthermore, the left side wall 21 of the first handle part 20 has an inner surface 212, which abuts against the second handle part 10. Each of the first, second and third spring-biased positioning elements 30 has a large-diameter inner portion 311 and a small-diameter outer portion 312", which has a diameter that is smaller than that of the large-diameter inner portion 311, thereby defining a shoulder 313 between the small-diameter outer portion 312" and the large-diameter inner portion 311. The positioning hole unit 214 in the first handle part 20 is larger in diameter than the small-diameter outer portions 312" of the first and second spring-biased positioning elements 30 and is smaller in diameter than the large-diameter inner portions 311 of the spring-biased positioning elements 30, thereby permitting abutment of the shoulders 313 of the spring-biased positioning elements 30 against the inner surface 212 of the left side wall 21 of the first handle part 20 when the second handle part 10 is located at the alignment position and the first and second inclined positions.

In the preferred embodiment, the distal end of the shank 11 defines a tool bit mounting hole 111 of a hexagonal cross section such that tool bits of different configurations can be mounted in the hole 111 for driving screws with different head configurations. The first handle part 20 can be formed with a bit accommodation chamber 216 and a lid 218 detachably mounted thereto so as to close the chamber 216.

With this invention thus explained, it is apparent that numerous modifications and variations can be made without departing from the scope and spirit of this invention. It is therefore intended that the invention be limited only as indicated in the appended claims.

I claim:

1. A handle for a screwdriver-type tool, said handle comprising:

an elongated first handle part having an integral wall with a positioning hole unit that is formed therethrough; and an elongated second handle part connected pivotally to an end of said first handle part at an end thereof and rotatable between an alignment position, where said first and second handle parts are aligned with each other, and a first inclined position, where said first and second handle parts form an obtuse angle therebetween, said second handle part having a first spring-biased positioning element and a second spring-biased positioning element, which are retained thereon, each of said first and second spring-biased positioning elements having an outer end, said first spring-biased positioning element extending through said positioning hole unit in said first handle part in such a manner that said outer end thereof projects from said positioning hole unit when said second handle part is at said alignment position for locking said second handle part at said alignment position, said second spring-biased positioning element extending through said positioning hole unit in said first handle part in such a manner that said outer end thereof projects from said positioning hole unit when said second handle part is at said first inclined position for locking said second handle part at said first inclined position;

whereby, when said second handle part is at said alignment position, said outer end of said first spring-biased positioning element can be pushed inwardly to disengage said first spring-biased positioning element from said positioning hole unit in said first handle part so as to unlock said first and second handle parts from each other, thereby permitting rotation of said second handle part to said first inclined position, and when said second handle part is at said first inclined position, said outer end of said second spring-biased positioning element can be pushed inwardly to disengage said second spring-biased positioning element from said positioning hole unit in said first handle part so as to unlock said first and second handle parts from each other, thereby permitting rotation of said second handle part to said alignment position.

2. The handle as defined in claim 1, wherein said integral wall is formed with a counterbore therethrough, said counterbore having a uniform-diameter inner section that constitutes said positioning hole unit, and an enlarged outer section that has a diameter larger than that of said uniform-diameter inner section, said outer end of said first spring-biased positioning element being located in said enlarged outer section when said second handle part is at said alignment position, said outer end of said second spring-biased positioning element being located in said enlarged outer section when said second handle part is at said first inclined position for preventing undesired contact with said outer end of each of said first and second spring-biased positioning elements.

3. The handle as defined in claim 1, wherein said second handle part further includes a third spring-biased positioning element retained therein, said third spring-biased positioning element extending through said positioning hole unit when said second handle part is at a second inclined position for locking said second handle part at said second inclined position.

4. The handle as defined in claim 1, wherein said wall of said first handle part has an inner surface, which abuts against said second handle part, each of said first and second spring-biased positioning elements having a large-diameter inner portion and a small-diameter outer portion, which has a diameter that is smaller than that of said large-diameter inner portion, thereby defining a shoulder between said small-diameter outer portion and said large-diameter inner portion, said positioning hole unit in said first handle part being larger in diameter than said small-diameter outer portions of said first and second spring-biased positioning elements and being smaller in diameter than said large-diameter inner portions of said first and second spring-biased positioning elements, thereby permitting abutment of said shoulders of said first and second spring-biased positioning elements against said inner surface of said wall of said first handle part when said second handle part is located at said alignment position and said first inclined position.

* * * * *